US007180018B2

(12) United States Patent
Sekino et al.

(10) Patent No.: US 7,180,018 B2
(45) Date of Patent: Feb. 20, 2007

(54) SWITCH DEVICE

(75) Inventors: Yutaka Sekino, Hadano (JP); Hideji Onodera, Tokyo (JP); Takeshi Fujimoto, Tokyo (JP)

(73) Assignees: Niles Co., Ltd., Tokyo (JP); Nissan Motor Co., Ltd., Tokyo (JP)

( * ) Notice: Subject to any disclaimer, the term of this patent is extended or adjusted under 35 U.S.C. 154(b) by 0 days.

(21) Appl. No.: 11/165,785

(22) Filed: Jun. 23, 2005

(65) Prior Publication Data

US 2005/0284736 A1 Dec. 29, 2005

(30) Foreign Application Priority Data

Jun. 25, 2004 (JP) ..... 2004-188802

(51) Int. Cl.
*H01H 9/26* (2006.01)
*H01H 13/72* (2006.01)
*H01H 13/76* (2006.01)

(52) U.S. Cl. ..... 200/5 A; 200/5 R

(58) Field of Classification Search ..... 200/5 A, 200/5 R, 1 R, 6 A, 6 R, 16 R, 17 R, 18
See application file for complete search history.

(56) References Cited

U.S. PATENT DOCUMENTS 4,428,649 A * 1/1984 Main et al. ..... 359/876
4,866,221 A * 9/1989 Obermann et al. ..... 200/5 R
4,937,402 A * 6/1990 Kyoden ..... 200/5 R
4,975,547 A * 12/1990 Nakayama et al. ..... 200/5 R

FOREIGN PATENT DOCUMENTS

JP 11-288644 10/1999

* cited by examiner

*Primary Examiner*—Elvin Enad
*Assistant Examiner*—Lheiren Mae A. Anglo
(74) *Attorney, Agent, or Firm*—Jordan and Hamburg LLP

(57) ABSTRACT

In a switch device including: a push button disposed in an opening of a switch case and operable to be tilted in any one of a plurality of directions by being pushed at an outer edge side; a rubber contact that forces the push button to a position before pushing; and a movable contact and a fixed contact connectable to each other by each pushing operation on the push button, a convex portion and a concave portion that can be spaced apart from each other are separately provided to the push button and the switch case for rotational support and positional regulation of the push button with respect to the switch case at the time of a tilting operation by each pushing.

20 Claims, 5 Drawing Sheets

SWITCH DEVICE

BACKGROUND OF THE INVENTION

1. Field of the Invention

The present invention relates to a switch device for use as, for example, a door mirror switch of a vehicle.

2. Description of the Related Art

An example of a conventional switch device of this type is disclosed in Japanese Patent Laid-Open Publication No. 11-288644, and is shown in FIGS. 10 and 11. FIG. 10 is a plan view of a conventional switch device, and FIG. 11 is a sectional view thereof.

A switch device 101 shown in FIGS. 10 and 11 is used for, by way of example, changing and adjusting the direction of a mirror surface of a left or right door mirror upward, downward, rightward, or leftward. The switch device 101 includes a push button 107 as a push operation body provided to an opening 105 of a switch case 103.

The push button 107 is provided with four convex portions 109 as markers corresponding to up, down, right, and left movements of the door mirror to indicate push operation portions. The push button 107 is also provided with a flange 111 in the opening 105.

The switch case 103 is provided with a wall 113 that surrounds the perimeter of the flange 111. The wall 113 stops a movement in a direction along the opening 105 of the flange 111 (such a movement is hereinafter simply referred to as a "lateral movement" in the drawing) to regulate a still position of the push button 107.

Between the push button 107 and the switch case 103, a spring 115 is provided to force the push button 107 to a position before pushing.

Correspondingly to each convex portion 109 indicating a push position, an actuator 117 is supported by the switch case 103 so as to be able to move in an axial direction. Provided at the bottom end of each actuator 117 is a rubber contact 119. The rubber contact 119 is provided with a movable contact 121. Opposite to the movable contact 121, a fixed contact 125 is provided to an electrical circuit board 123.

Thus, upon pushing any one of the convex portions 109 on the push button 107 for a tilting operation, the actuator 117 positioned at a side corresponding to this tilting is pressed to the axial direction to be moved, thereby deforming the rubber contact 119. With the deformation of the rubber contact 119, the movable contact 121 comes into contact with the fixed contact 125. With this contacting, a motor for operating the door mirror is driven via the circuit board 123, thereby allowing the direction of the door mirror to be changed and adjusted upward, downward, rightward, or leftward according to the pushing operation of the push button 107.

When no tilting operation is performed on the push button 107, the push button 107 keeps the still position in the opening 105 by a force of the spring 115. At this time, the wall 113 is adjacent to the outer perimeter of the flange 111, thereby allowing the still position of the push button 107 to be regulated by stopping the movement of the flange 111 by the wall 113.

However, the above-described structure poses problems such that, at the time of a tilting operation of the push button 107, a rubbing sound may occur and, due to a rubbing feeling, the feeling of operation is not good.

FIG. 12 shows the structure of a push button similar to that shown in FIGS. 10 and 11, and illustrates the state in which the push button 107 is pushed for a tilting operation.

As shown in FIG. 12, when the push button 107 is pushed at any of the convex portions 109, a force Fsinè occurs in a lateral direction with respect to a push operation force F. Therefore, the push button 107 is laterally moved in the direction of the force Fsinè with respect to the opening 105. Therefore, during the pushing operation, the flange 111 comes into contact with the wall 113 to cause the rubbing sound and the rubbing feeling as described above.

SUMMARY OF THE INVENTION

Problems to be solved by the invention include an occurrence of a rubbing sound and a reduction in the feeling of operation due to a rubbing feeling.

One of the most main features of the present invention is that, in order to allow suppression of a rubbing noise and improvement in the feeling of operation, a supporting portion and a supported portion that can be spaced apart from each other are separately provided to the push operation body and the switch case for rotational support and positional regulation of the push operation body with respect to the switch case at the time of a tilting operation by each pushing.

In the switch device according to the present invention, the supporting portion and the supported portion that can be spaced apart from each other are separately provided to the push operation body and the switch case for rotational support and positional regulation of the push operation body with respect to the switch case at the time of a tilting operation by each pushing. Therefore, at the time of the tilting operation on the push operation body by the pushing, the supporting portion and the supported portion can stop a force in a direction along an opening of the switch case occurring at the time of the tilting operation on the push operation body by a pushing. With this, the movement of the push operation body with respect to the opening can be regulated.

Thus, at the time of the tilting operation by pushing the push operation body, a rubbing sound between the push operation body and the switch case side can be suppressed.

Also, at the time of the tilting operation by pushing the push operation body, a rubbing feeling can be suppressed, and the feeling of operation of the push operation body can be improved.

In the case where the push operation body includes a flange disposed in the switch case, and a push portion protruding outward from the opening to the switch case and the supporting portion and the supported portion are separately provided to the flange and an inner surface of the switch case opposite to the flange, rotational support and positional regulation of the flange with respect to the switch case can be performed by the supporting portion and the supported portion. With this, a rubbing noise can be suppressed and the feeling of operation can be improved.

In the case where the flange has a square shape in a plane view and the supporting portion and the supported portion are separately provided to a corner portion of the flange and a portion of an inner surface of the switch case opposite to the corner portion of the flange, the push operation body can have four positions between the corner portions as push positions, thereby improving a function of a switch device.

In the case where a swelled portion in a plane direction is provided at the corner portion of the flange and the supporting portion and the supported portion are separately provided to the swelled portion and a portion of the inner surface of the switch case opposite to the swelled portion, a distance between a point for rotational support and positional regulation by the supporting portion and the supported portion and the opening can be increased, thereby reducing a tilting range of the push operation body by a pushing. Therefore, the force occurring in the direction along the opening at the time of the pushing can be reduced. With this, suppression of a rubbing sound and an improvement in the feeling of operation can be more reliably achieved.

In the case where the supporting portion and the supported portion are a convex portion and a concave portion each having a spherical shape and engaging with each other, rotational support and positional regulation of the push operation body with respect to the switch case can be more reliably and smoothly performed. With this, suppression of a rubbing sound and an improvement in the feeling of operation can be more reliably achieved.

In the case where the switch case is provided with a wall that enables to regulate a still position of the push operation body with respect to the opening, when the push operation body is positioned in the opening before a pushing operation, the wall enables to stop the movement of the push operation body in a direction along the opening. Furthermore, when the tilting operation is performed by pushing the push operation body, rotational support and the positional regulation of the push operation body are performed by the supporting portion and the supported portion, thereby reliably suppressing a rubbing sound occurring between the push operation body side and the wall and also reliably suppressing a reduction in the feeling of operation due to a rubbing feeling.

DETAILED DESCRIPTION OF THE PREFERRED EMBODIMENTS

Objects of the present invention, that is, suppression of a rubbing sound and an improvement in the feeling of operation, are achieved by providing a supporting portion and a supported portion.

Figure 1:
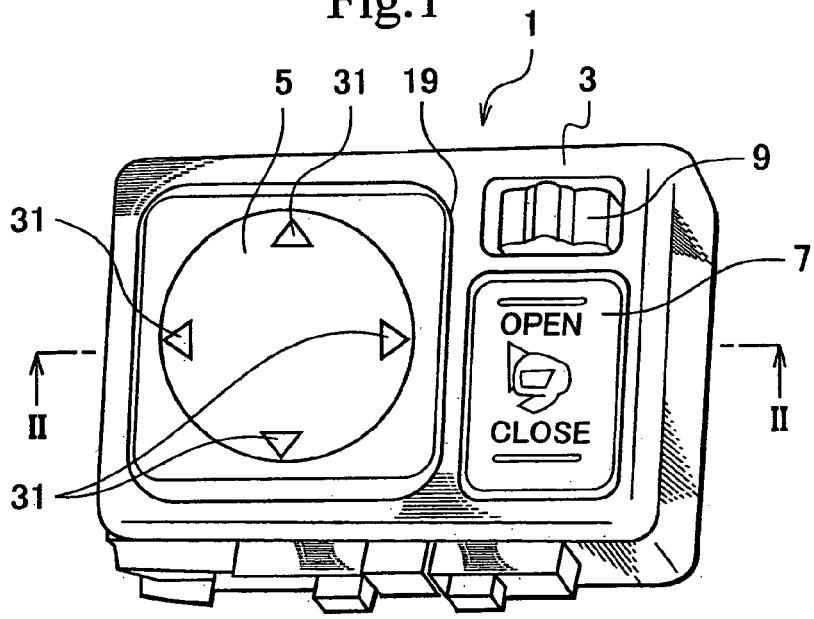
FIG. 1 is a perspective view of a switch device according to an embodiment of the present invention.
Figure 2:
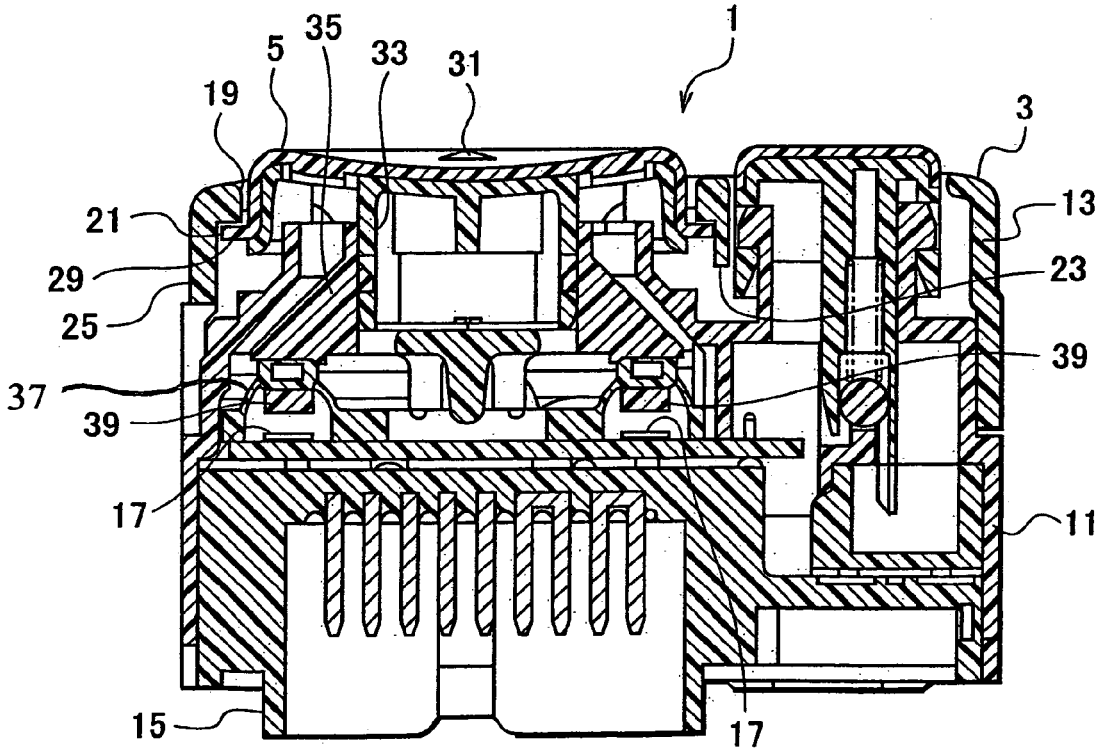
PRIOR ART Fig.2
FIG. 2 is a sectional view taken along a line II—II of FIG. 1 according to the embodiment.

FIGS. 1 and 2 show a switch device to according to an embodiment of the present invention. FIG. 1 is a perspective view of the switch device, and FIG. 2 is a sectional view thereof taken along a line II—II of FIG. 1. A switch device 1 illustrated in FIGS. 1 and 2 are, for example, to operate a right or left door mirror of a vehicle. The switch device 1 includes a push button 5 serving as a push operation body, a seesaw switch 7, and a slide switch 9 on a switch case 3.

The push button 5 is to change and adjust the direction of a mirror surface of a right or left door mirror upward, downward, rightward, or leftward. The seesaw switch 7 has an open-operation portion and a close-operation portion. Upon an operation on one of these portions, the position of the door mirror can be changed to a use state or a folded state. The slide switch 9 is subjected to a sliding operation toward right or left, thereby switching the adjustment of the mirror surface by the push button 5 to either one of the right and left mirrors.

The switch case 3 supports the push button 5, the seesaw switch 7, and the slide switch 9. The switch case 3 includes a base 11 and a cover 13 attached to the base 11 removably.

A terminal block 15 is removably mounted on the base 11. The terminal block 15 is provided with a plurality of fixed contacts 17 correspondingly to operations of the push button 5.

At the cover 13 side, an opening 19 is provided in which the push button 5 is disposed. The opening 19 has a square shape in a plan view. According to the present embodiment, the opening 19 has an approximately foursquare shape, for example. In the opening 19, an engaging surface 21 is formed along the perimeter of the opening 19 to define an inner surface of the switch case 3. Provided around the perimeter of the engaging surface 21 is a wall 23. The wall 23 enables to regulate a still position of the push button 5 with respect to the opening 19. The wall 23 at a circumferential wall 25 side of the cover 13 is defined by the circumferential wall 25.

The push button 5 is disposed in the opening 19 of the switch case 3, and can be operated so as to be tilted to one of a plurality of directions by pushing an outer edge side. According to the present embodiment, the push button 5 can be operated so as to be tilted in one of four directions by pushing any one of four portions. Tilting operations of the push button 5 in the four directions correspond to in up, down, right, and left movements of the mirror surface of the door mirror. The push button 5 has a square shape in a plan view, typically in an approximately foursquare shape. The push button 5 includes a push portion 27 (see FIG. 7) and a flange 29, and a flange 29, and is formed in an approximately hat section shape.

The push portion 27 protrudes from the opening 19, and is provided on its upper surface with four triangular marks 31 as marks for operation. The flange 29 engages in an opposed manner with an engaging surface 21 in the switch case 3. The wall 23 is adjacent to the outer perimeter of the flange 29, and has a structure in which the wall 23 enables to stop the flange 29 when the flange 29 moves to a direction along the opening 19 (such a movement is hereinafter referred to as a "lateral movement").

Provided at the center of the bottom surface of the push button 5 is a connector 33. To the connector 33, an operating member 35 is removably provided. At a tip side of the operating member 35, a rubber contact 37 supported to the switch case 3 is provided. The rubber contact 37 has an elastic force, and an elastic reaction force of the rubber contact 37 is exerted to the push button 5 via the operating member 35.

Therefore, the push button 5 has a structure in which the elastic reaction force of the rubber contact 37 causes the push portion 27 to protrude from the opening portion 19, thereby keeping the still position at which the flange 29 engages with the engaging surface 21. Thus, the rubber contact 37 forms elastic member that forces the push button 5 as a push operation body to a position before pushing.

The rubber contact 37 is provided with four movable contacts 39 that correspond to the triangular marks 31, which indicate push positions. Therefore, upon pushing any one of the marks 31 on the push button 5, the push button 5 is tilted to cause the corresponding pushed portion to go downward, thereby deforming the rubber contact 37 via the connector 33 and the operating member 35. With the deformation of the rubber contact 37, the corresponding movable contact 39 comes into contact with the fixed contact 17, thereby allowing the direction of the mirror surface of the door mirror to be selectively adjusted upward, downward, rightward, or leftward.

To the push button 5 and the switch case 3, a convex portion and a concave portion are separately provided as a supporting portion and a supported portion that can be spaced apart from each other for rotational support and positional regulation of the push button 5 with respect to the switch case 3 at the time of a tilting operation by a pushing at each mark 31.

Figure 3:
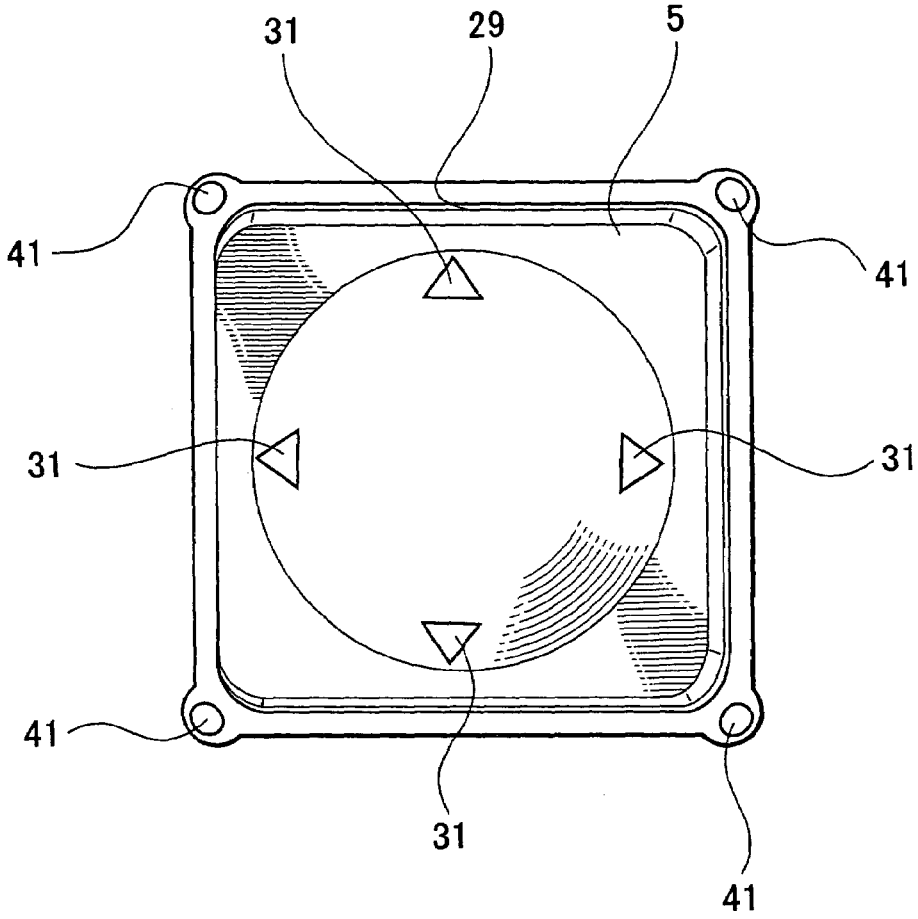
FIG. 3 is an enlarged plan view of a push button according to the embodiment.
Figure 4:
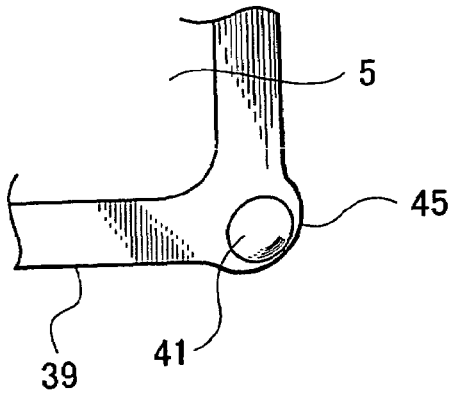
FIG. 4 is an enlarged plan view of a corner portion of the push button according to the embodiment.
Figure 5:
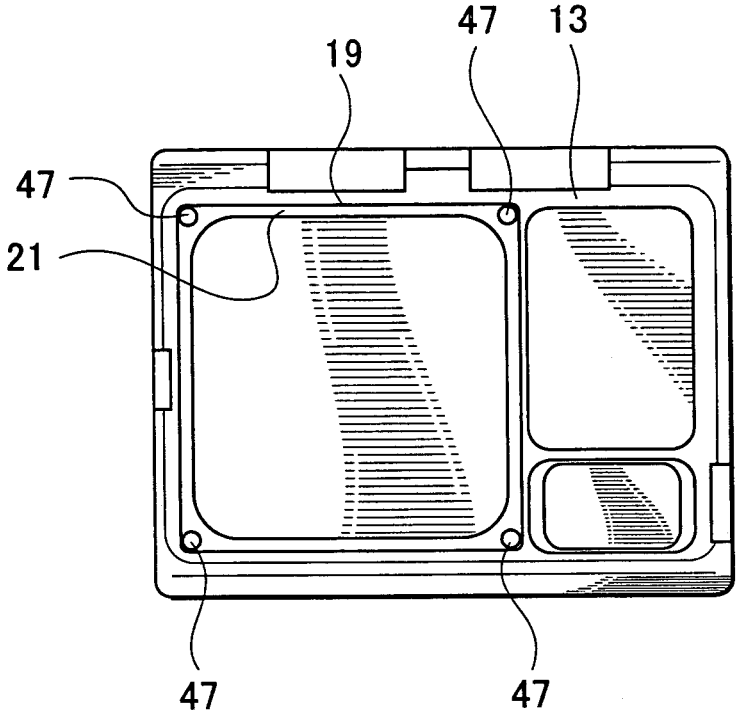
FIG. 5 is a plan view of an inner surface of a cover of a switch case according to the embodiment.
Figure 6:
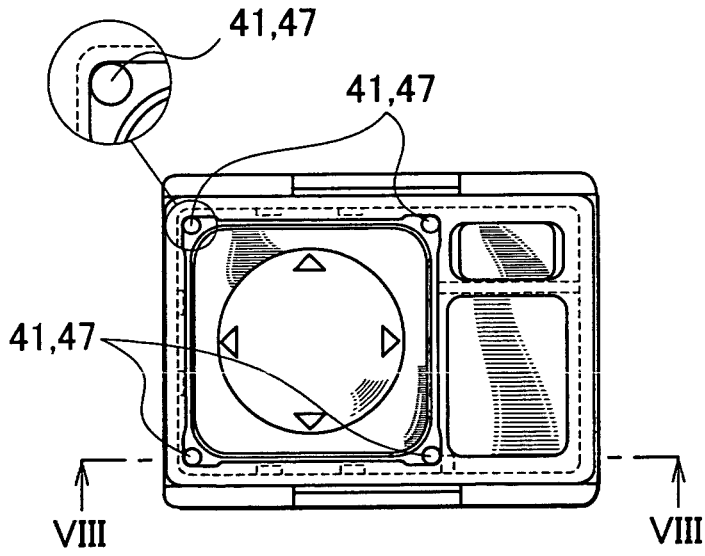
FIG. 6 is a plan view of the push button and the cover showing positions of convex and concave portions.
Figure 7:
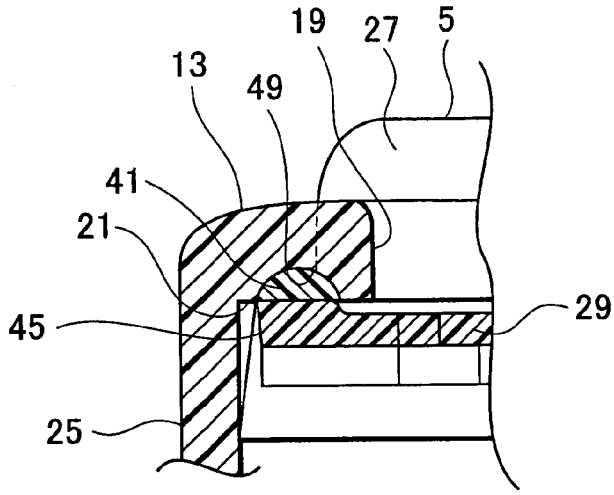
FIG. 7 is an enlarged sectional view showing main portions taken along a line VIII—VIII of FIG. 6.
Figure 8:
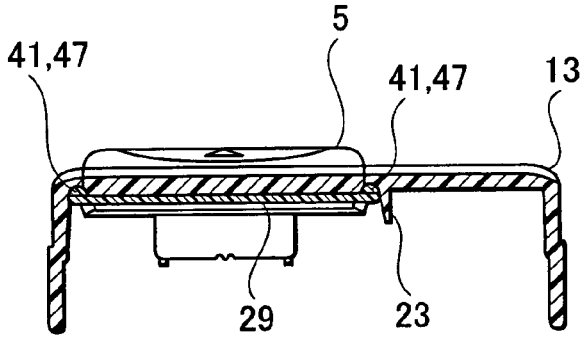
FIG. 8 is a sectional view taken along the line VIII—VIII of FIG. 6.
Figure 9:
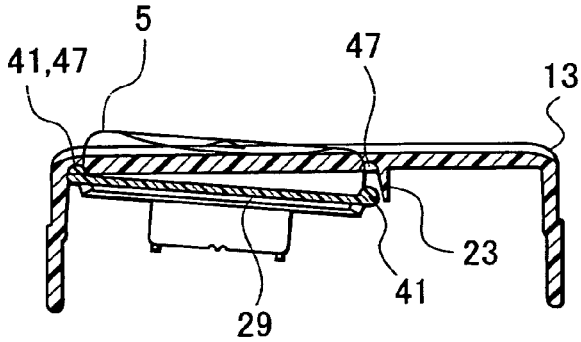
FIG. 9 is a sectional view after an operation of tilting the push button of in FIG. 8.
Figure 10:
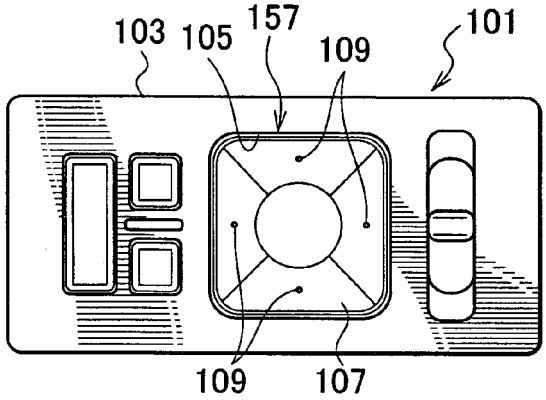
Fig.10 RELATED ART
FIG. 10 is a plan view of a switch device according to a related art.
Figure 11:
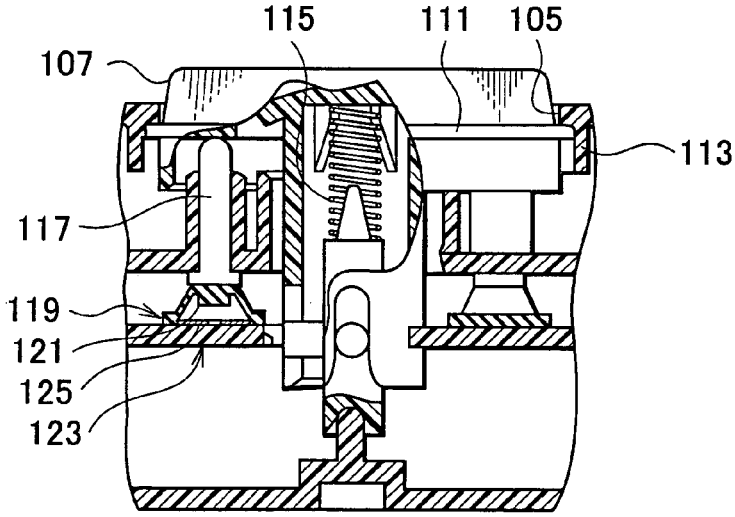
Fig.11 RELATED ART
FIG. 11 is a sectional view of the switch device according to the related art.

FIGS. 3 to 9 are drawings showing the convex and concave portions. FIG. 3 is an enlarged plan view of the push button 5, FIG. 4 is an enlarged plan view of main portions of the push button 5, FIG. 5 is a plan view of an inner surface side of the cover 13 of the switch case 3, FIG. 6 is a plan view of positions of convex and concave portions between the switch case and the push button, FIG. 7 is an enlarged sectional view showing main portions taken along a line VIII—VIII of FIG. 6, FIG. 8 is a sectional view taken along the line VIII—VIII of FIG. 6, and FIG. 9 is a sectional view after an operation of tilting the push button of FIG. 8.

As shown in FIGS. 3 and 4, the flange 29 of the push button 5 has corner portions each provided with a convex portion 41. The surface of the convex potion 41 is formed in a spherical shape. The corner portions of the flange 29 are each provided with a swelled portion 45 in a plane direction. The swelled portion 45 is where the convex portion 41 is provided.

As shown in FIG. 5, corner portions on the inner surface of the switch case 3 opposite to the corner portions of the flange 29, that is, corner portions on the engaging surface 11 of the cover 13, are each provided with a concave portion 47. The surface of the concave potion 47 has a spherical shape corresponding to the convex portion 41. Thus, according to the present embodiment, the convex and concave portions 41 and 47 are each formed in a spherical shape allowing a spherical guide without a rattle between these portions. However a rattle between the spherical surfaces of the convex and concave portions 41 and 47 is allowable to a certain degree as long as the flange 29 does not make contact with the wall 23 or, even if making contact therewith, no rubbing sound is generated.

In the above-described structure, the convex and concave portions 41 and 47 are separately provided to the flange 29 and the engaging surface 21, which is the inner surface of the switch case opposite to the flange 29. Alternatively, the convex portion 41 may be provided to the cover 13 side and the concave portion 47 may be provided to the flange 29 of the push button 5.

FIGS. 6 and 7 illustrate the state in which the convex portion 41 engages with the concave portion 47 with the push button 5 being disposed in the opening 19 of the cover 13. In FIG. 6, for the purpose of description, the concave and convex portions 47 and 41 are represented by solid lines although they are actually hidden by the cover 13.

With the push button 5 being disposed in the opening 19 of the cover 13, the convex portion 41 of the flange 29 engages with the concave portion 47 of the engaging surface 21 of the cover 13 for positional regulation. In this state, the push button 5 is forced by the rubber contact 37, and the convex portion 41 at each corner portion of the flange 29 engages with the corresponding concave portion 47 at the corner portion of the engaging surface 21, thereby regulating the still position with the force of the rubber contact 37. This regulation of the still position can reliably suppress a rattle of the push button 5. Also, the wall 23 enables to stop a lateral movement of the push button 5, thereby reliably suppressing a rattle of the push button 5. Furthermore, when the push button 5 is pushed for a tilting operation, the convex portion 41 is easily removed from the concave portion 47 so as to be spaced apart therefrom.

In the state shown in FIG. 8, when the push button 5 is pushed at any one of the marks 31 in order to adjust the mirror surface of the door mirror, the push button 5 is tilted with respect to the cover 13, as shown in FIG. 9. At this tilting, the convex portions 41 positioned at both corner portions of the mark 31 at the pushed position are removed from the corresponding concave portions 47 of the engaging surface 21, and the convex portions 41 positioned at both corner portions opposite to those of the mark 31 at the pushed position are guided in rotation by the corresponding concave portions 47 of the engaging surface 21.

Figure 12:
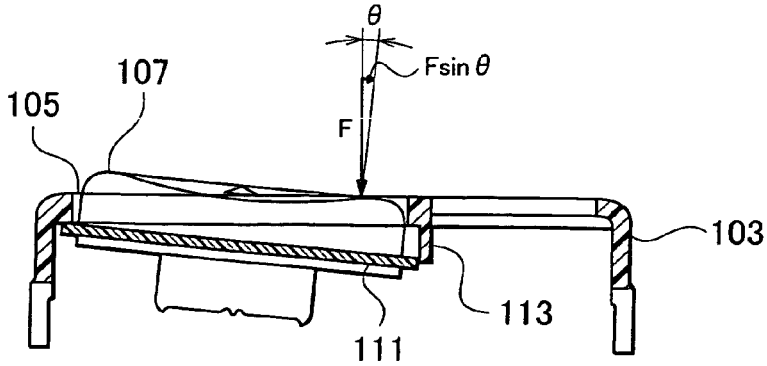
Fig.12 RELATED ART
FIG. 12 is a sectional view showing a tilt of a switch button according to the related art.

Therefore, at the time of pushing the push button 5, even when a force Fsinè as shown in FIG. 12 is generated, the force Fsinè is stopped by the convex portions 41 engaging with the concave portions 47 as described above. Therefore, the push button 5 does not move in the lateral direction with respect to the opening 19, and is rotationally tilted at the same position as shown in FIGS. 8 and 9.

As such, even when the flange 29 is close to the wall 23, the flange 29 of the push button 5 is prevented or suppressed from rubbing against the wall 23, thereby preventing or suppressing a rubbing sound. Also, the feeling of rubbing can be prevented or suppressed, thereby significantly improving the feeling of operation.

As described above, the concave and convex portions 47 and 41 are provided at four positions corresponding to the corner portions of the push button 5. Therefore, at whichever the four marks 31 the push button 5 is pushed, effects that can be achieved are similar.

In the above embodiment, the present invention is applied to the push button 5 and the opening 19 each having a square shape in a plane view. Alternatively, the present invention may be applied to the push button 5 and the opening 19 each having a rectangular or circular shape, for example. Still alternatively, only the flange 29 may be formed in a square shape, and the push portion 27 and others may be formed in a circular shape, for example. The convex and concave portions 41 and 47 can be arbitrary as long as these portions achieve rotational support and positional regulation and can be spaced apart from each other. Also, the convex and concave portions may be wedge-shape convex and concave portions, for example. The supporting and supported portions are not restricted to the convex and concave portions 41 and 47. Furthermore, the supporting and supported portions that can be spaced apart from each other are not restricted to those that can be completely removed from each other, but may be those connected partly by an elastically-extendable portion or the like.

The operation positions of the push button 5 are not restricted to four positions, but may be two positions opposite to each other, for example.

What is claimed is:

1. A switch device comprising:

a switch case defining an opening and having an inner surface;

a push operation body having outer edge sides and a flange opposing said inner surface, said push operation body being disposed in said opening of said switch case with said flange opposing said inner surface and operable to be tilted in any one of a plurality of directions by being pushed at respective ones of said outer edge sides;

an elastic member that forces the push operation body to an initial position before pushing;

a movable contact and a fixed contact selectively connectable to each other by a pushing operation on the push operation body a supporting portion and a supported portion engaging one another when the push operation body is in said initial position and that can be spaced apart from each other and that are separately provided to the push operation body and the switch case for rotational support and positional regulation of the push operation body with respect to the switch case during tilting of the push operation body; and said supporting portion being fixedly provided to one of said flange and said inner surface, and said supported portion being fixedly provided to another one of said flange and said inner surface.

2. The switch device according to claim 1, wherein the push operation body includes a push portion protruding outward from the opening of the switch case.

3. The switch device according to claim 2, wherein the supporting portion and the supported portion are a convex portion and a concave portion each having a spherical shape and engaging with each other.

4. The switch device according to claim 3, wherein the switch case is provided with a wall that regulates a still position of the push operation body with respect to the opening.

5. The switch device according to claim 2, wherein the switch case is provided with a wall that regulates a still position of the push operation body with respect to the opening.

6. The switch device according to claim 2, wherein the flange has a square shape in a plane view, and the supporting portion and the supported portion are separately provided to a corner portion of the flange and a portion of an inner surface of the switch case opposite to the corner portion of the flange. body with respect to the opening.

7. The switch device according to claim 1, wherein the supporting portion and the supported portion are a convex portion and a concave portion each having a spherical shape and engaging with each other.

8. The switch device according to claim 7, wherein the switch case is provided with a wall that regulates a still position of the push operation body with respect to the opening.

9. The switch device according to claim 1, wherein the switch case is provided with a wall that regulates a still position of the push operation body with respect to the opening.

10. A switch device, comprising:

a switch case defining an opening and having an inner surface;

a push operation body having a flange, said push operation body being disposed in said opening of said switch case with said flange opposing said inner surface and operable to be tilted in any one of a plurality of directions by being pushed at an outer edge side;

an elastic member that forces the push operation body to a position before pushing;

a movable contact and a fixed contact connectable to each other by each pushing operation on the push operation body a supporting portion and a supported portion that can be spaced apart from each other are separately provided to the push operation body and the switch case for rotational support and positional regulation of the push operation body with respect to the switch case at a time the push operation body is tilted;

said push operation body includes a push portion protruding outward from the opening to the switch case; and the flange having a square shape in a plane view, and the supporting portion and the supported portion are separately provided to a corner portion of the flange and a portion of the inner surface of the switch case opposite to the corner portion of the flange.

11. The switch device according to claim 10 wherein a swelled portion in a plane direction is provided at the corner portion of the flange, and the supporting portion and the supported portion are separately provided to the swelled portion and a portion of the inner surface of the switch case opposite to the swelled portion.

12. The switch device according to claim 11 wherein the supporting portion and the supported portion are a convex portion and a concave portion each having a spherical shape and engaging with each other.

13. The switch device according to claim 12, wherein the switch case is provided with a wall that regulates a still position of the push operation body with respect to the opening.

14. The switch device according to claim 11, wherein the switch case is provided with a wall that regulates a still position of the push operation body with respect to the opening.

15. The switch device according to claim 10, wherein the supporting portion and the supported portion are a convex portion and a concave portion each having a spherical shape and engaging with each other.

16. The switch device according to claim 15, wherein the switch case is provided with a wall that regulates a still position of the push operation body with respect to the opening.

17. The switch device according to claim 10, wherein the switch case is provided with a wall that regulates a still position of the push operation body with respect to the opening.

18. A switch device comprising:

a switch case defining an opening and having an inner surface adjacent a periphery of said opening;

a push operation body having a flange and outer edges, said push operation body being disposed in said opening of said switch case with said flange opposing said inner surface and operable to be tilted in any one of a plurality of directions by being pushed respectively at ones of said outer edges;

said inner surface acting as an engaging surface opposing and engaging said flange;

an elastic member biasing the push operation body to an initial position from which the push operation body is pushed;

a movable contact and a fixed contact connectable and disconnectable to each other by tilting movement of the push operation body;

a supporting portion and a supported portion engageable with and separable from each other;

said supporting portion being fixedly provided to one of said flange and said engaging surface, and said supported portion being fixedly provided to another one of said flange and said engaging surface; and said supporting portion and said supported portion being configured to engage one another when the push operation body is at the initial position and rotate relative one another so as to provide rotational support and positional regulation of the push operation body with respect to the switch case during the tilting movement of the push operation body.

19. The switch device of claim 18 wherein said push operation body includes a push portion protruding outward from the opening to the switch case and said outer edges being disposed on said push portion.

20. The switch device according to claim 18, wherein the supporting portion and the supported portion are a convex portion and a concave portion each having a semicircular shaped cross section portion engaging with each other.

* * * * *